US005415697A

United States Patent [19]

MacDonald et al.

[11] Patent Number: 5,415,697

[45] Date of Patent: May 16, 1995

[54] CLEANING OF SPINNERETTE JETS

[75] Inventors: Jacqueline F. MacDonald, Henley Green; Alan Owens, Nuneaton, both of United Kingdom

[73] Assignee: Courtaulds Fibres (Holdings) Limited, London, England

[21] Appl. No.: 69,348

[22] Filed: May 28, 1993

[51] Int. Cl.[6] ..... B08B 3/00; B08B 3/08

[52] U.S. Cl. ..... 134/26; 134/30; 134/38

[58] Field of Search ..... 134/26, 27, 28, 29, 134/30, 25.4, 32, 34, 38

[56] References Cited

U.S. PATENT DOCUMENTS 5,011,541 4/1991 Leech ..... 134/34

OTHER PUBLICATIONS

"Slow Holes in Spinneret for Wet Process Spinning," 27(2) Man-Made Textiles in India 82-86 (Abstract 1984).

*Primary Examiner*—Scott Kastler
*Assistant Examiner*—Saeed Chaudhry
*Attorney, Agent, or Firm*—David Hoxie Faithfull & Hapgood

[57] ABSTRACT

A method and apparatus for cleaning and unblocking dope from jet holes (14) of a spinnerette plate (13) used in the manufacture of solvent-spun cellulose fibre. The method comprises the steps of soaking the spinnerette plates (12) in a solvent for the dope, flushing the solvent in a first direction through the jet holes (14) flushing the solvent in the reverse direction through the jet holes 14. The solvent is washed off in a water ultrasonic bath. The spinnerette plates are then steam cleaned and then ultrasonically cleaned in a cleaning agent which will dislodge remnants of cellulose from the spinnerette plates 13.

4 Claims, 3 Drawing Sheets

CLEANING OF SPINNERETTE JETS

BACKGROUND OF THE INVENTION

This invention relates to the cleaning of spinnerette jets of a solvent-spun fibre production plant.

In the manufacture of solvent-spun fibres, such as for example Teneel cellulose fibres (Teneel is a trade mark of Courtaulds Fibres Limited), a dope comprising wood pulp dissolved in an aqueous solution of amine oxide, is pumped through a series of filters to a plurality of spinning heads. Each spinning head comprises a plurality of very thin metal plates in which thousands of spinnerette jet holes are punched. The jet holes are typically of the order of 80μ and are of trumpet shape.

It is vitally important to prevent the jets becoming blocked and to this extent a tremendous reliance is placed on designing filters upstream of the jets to filter the dope. Nevertheless there comes a time when it is necessary to dismantle the spinning head and clean the spinnerette jets.

In the past, the Spinnerette jets have been cleaned by soaking the spinnerette plates in hot demineralised water to regenerate the cellulose. Most of the dope can be removed this way, however, a number of jet holes remain blocked. The remaining blocked holes are usually cleaned by a combination of the use of steam cleaning, high power ultrasonic washing with water and the use of trichlorethylene ultrasonic treatment, and extremely careful inspection. The trichlorethylene ultrasonic treatment is an important stage in the present processes, but it is a relatively toxic part of the process and there is the need to reduce dependency on the use of trichlorethylene for this part of the process.

There is, therefore, a need for a reliable method of cleaning which is less dependent on the skills of inspectors searching thousands of jet holes for blockages to detect blocked holes, and which will not damage the spinnerette plates.

An object of the present invention is to provide a safe and reliable method of cleaning spinnerette jets of a spinning head of a solvent-spun fibre manufacturing plant.

BRIEF SUMMARY OF THE INVENTION

According to one aspect of the invention there is provided a method of cleaning and unblocking dope from jet holes in a spinnerette plate of a spinning head of a solvent-spun cellulose fibre manufacturing plant, the method comprising the steps of:

(a) scraping the bulk of the dope from the spinnerette plates, (b) soaking the spinnerette plate in the same solvent as used to make the dope, (c) causing the solvent to flow through the jet holes in a first direction, (d) causing the solvent to flow through the jet holes in the reverse direction to that of the first direction, (e) ultrasonically washing the solvent from the plates in hot demineralised water, (f) steam cleaning to remove regenerated residual cellulose from the jet holes, (g) ultrasonically washing the spinnerette plates in a cleaning agent which affects the physical properties of the regenerated cellulose rendering it more easy to dislodge the cellulose from the jet holes by the action of ultrasonic washing, and (h) ultrasonically washing regenerated cellulose from the jet holes.

In the case where the dope comprises an aqueous solution of cellulose in amine oxide, and the solvent used in steps (b), (c) and (d) is hot amine oxide.

Preferably the cleaning agent is a chlorinated hydrocarbon such as trichlorethylene.

According to a further aspect of the present invention there is provided apparatus for cleaning and unblocking dope from spinnerette jet holes of a spinnerette which is used in the manufacture of solvent-spun fibres, the apparatus comprising a vessel in which the spinnerette to be cleaned is mounted, the vessel having a first pipe connected to the vessel on one side of the spinnerette, a second pipe connected to the vessel on the other side of the spinnerette, and a bypass pipe which interconnects the internal volume of the vessel one side of the spinnerette with the internal volume of the vessel on the other side of the spinnerette, a tank for receiving solvent for the dope, a source of supply of solvent for the dope, a first three way valve having a first port connected to the source of supply by a third pipe, a second port connected to the vessel by way of the first pipe and a third port connected to the tank by way of a fourth pipe, the first valve being selectively movable to a first position where the first valve connects the source of supply of solvent to the vessel by way of the first pipe or to a second position where the first valve connects the vessel to the tank by way of the second pipe, a second valve having a first port connected to the source of supply by way of a fifth pipe, a second port connected to the vessel byway of the second pipe and a third port connected to the tank by way of a sixth pipe, the second valve being selectively movable to a first position where the second valve connects the source of supply of solvent to the vessel by way of the sixth pipe or to a second position where the second valve connects the vessel to the tank by way of the second pipe, and a third valve in the bypass pipe and operable to open or close the bypass pipe.

Preferably a means is provided for ultrasonically washing solvent from the plates in hot demineralised water.

Preferably steam cleaning means are provided for removing regenerated cellulose from the jet holes.

In the case where spinnerette plates used for the manufacture of cellulose fibres, a washing means is provided for ultrasonically washing cellulose remnants from the plates with a cleaning agent which affects the physical properties of the regenerated cellulose rendering it more easy to dislodge the cellulose from the jet holes by the action of ultrasonic washing.

BRIEF DESCRIPTION OF THE DRAWINGS

The present invention will now be described by way of an example with reference to the accompanying drawings in which.

DETAILED DESCRIPTION

Figure 1:
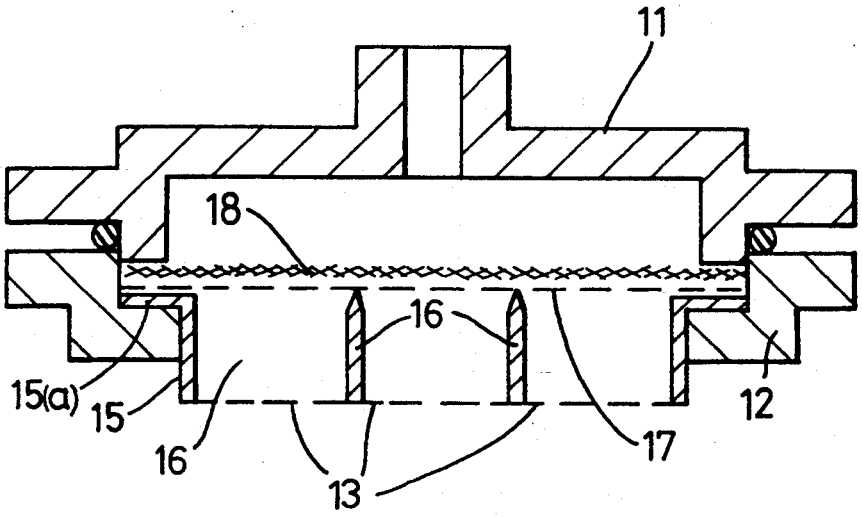
FIG. 1 shows schematically a cross-sectional view through a spinning head of a solvent-spun fibre manufacturing plant showing the spinnerette plates which require to be cleaned.
Figure 2:
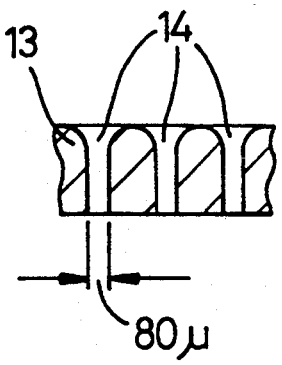
FIG. 2 shows an enlarged view of three spinnerette jet holes of the spinning head of FIG. 1.

Referring to FIG. 1 there is shown a spinning head 10 comprising a top housing 11 which is bolted to a bottom housing 12 and a spinnerette 15 which comprises six spinnerette plates 13, each of which has of the order of 3,000 spinnerette jet holes punched through the plates. The plates are about 1.4 mm thick. Each jet hole 14 (three of which are shown enlarged in FIG. 2) is 80μ diameter.

The spinnerette 15 has flanges 15*a* projecting normal to the plates 13 these flanges extend around the perimeter of the plates and act to support a perforated support plate 17 on which a single stainless steel 2-ply mesh filter 18 of 35μ to 37μ particle retention. The support plate 17 supports the filters 18 against the high pressure of the dope on the filters 18. Furthermore, the flanges 16 also provide local stiffness to assist the plates 13 from bowing under the pressure of dope exerted on the plates 13.

When the spinning head 10 is removed from the fibre production line for cleaning, the dope (typically an aqueous solution of wood pulp in amine oxide) congeals on the filters 18 and the plates 13 completely blocking the jet holes 14.

Figure 3:
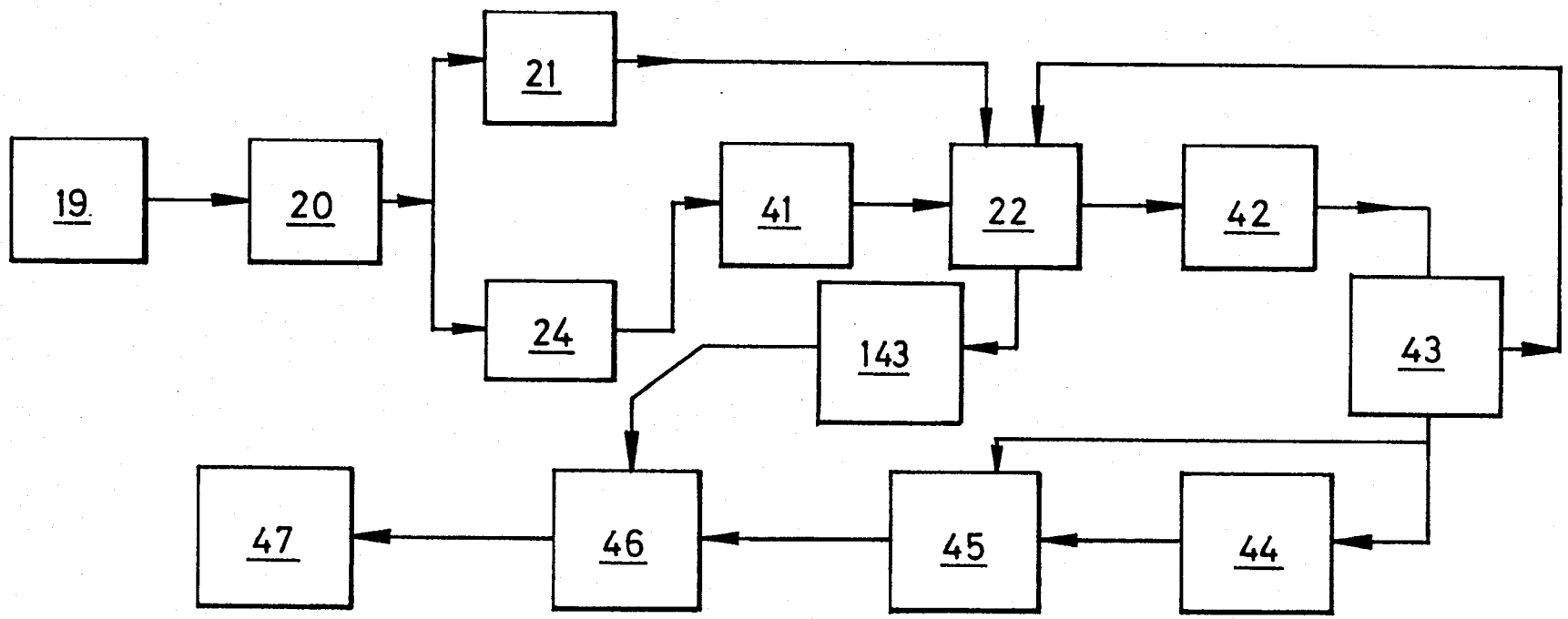
FIG. 3 shows schematically a block diagram flow chart of a method of cleaning the components of the spinning head shown in FIG. 1 in accordance with the present invention.

The spinning heads 10 must be disassembled whilst hot when the dope is still mobile to aid removal of the dope. Therefore the dirty components are kept hot in a heated enclosure 19 (see FIG. 3). The top housing 11 is separated from the bottom housing 12 and is scraped clean (step 20) and left to soak in hot demineralised water bath 21 (see FIG. 3) (typically 60° C.). During soaking, cellulose regenerates and shrinks; after a time the regenerated cellulose can be easily removed.

The support plate 17 is removed from the housing and it too is scraped to remove congealed dope and left to soak in hot (60° C.) demineralised water in bath 21.

The filter elements 18 are washed then thrown away.

Excess dope is very carefully scraped away from the plates 13 (step 20) but small amounts of dope congeal and remain blocking the jet holes 14 and cannot be removed by scraping.

After soaking, the top and bottom housings 11, 12 are steam cleaned using a steam gun 22. The components are then dried and then inspected at station 143.

Figure 4:
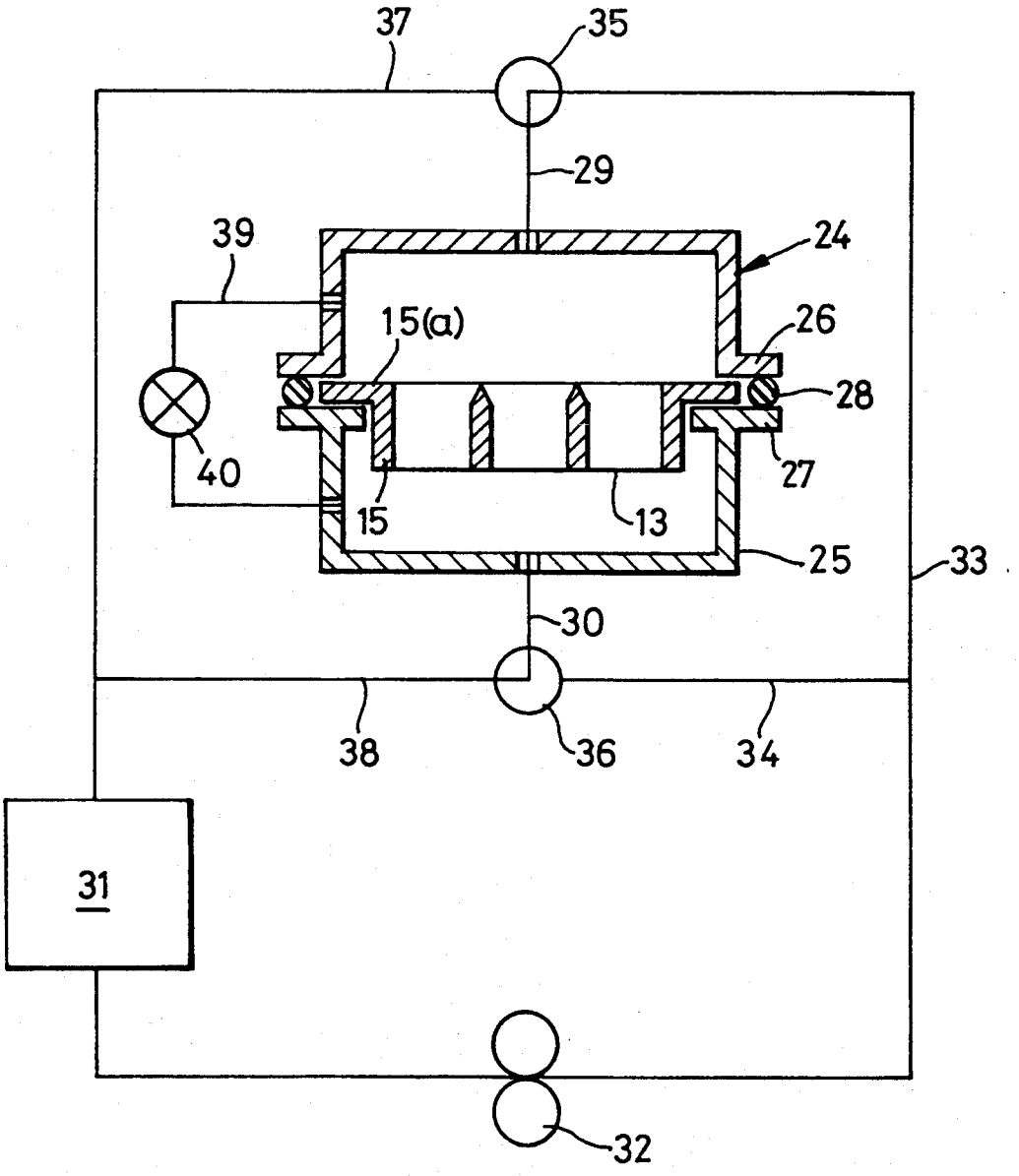
FIG. 4 shows schematically apparatus for carrying out the solvent washing part of the method of the present invention.

The spinnerette 15 is mounted in a solvent washing rig 24 as shown in FIG. 4.

Referring to FIG. 4 the solvent washing rig 24 comprises a sealable vessel 25 having confronting flanges 26, 27. The spinnerette 15 is mounted in the vessel 25 with the flange 15(*a*) of the spinnerette clamped between the flanges 26, 27 to make a fluid tight seal. The lower part of vessel 25 has a solid rod 28 welded onto the face of flange 27 which prevents the spinnerette 15 being too tightly clamped.

The vessel 25 is provided with two pipes. 29, 30; one of the pipes 29 is connected to the vessel 25 at one side of the spinnerette 15 and the other pipe 30 is connected to the vessel at the other side of the spinnerette 15.

Hot amine oxide (110° C.) from a sump tank 31 is pumped by a pump 32 through pipes 33, 34 to two mechanically interconnected valves 35, 36.

Valve 35 has three connections; the first connects to the source of supply of hot amine oxide via pipe 33, the second connects to the vessel 25 through pipe 29 and the third connects to the tank 31 via pipe 37. The valve 35 has two operating positions. In the first position it connects pipe 33 to pipe 29; in the second position it connects pipe 29 to pipe 37.

Valve 36 has three connections; the first connects to the source of supply of hot amine oxide via pipe 34, the second connects to the vessel 25 through the pipe 30 and the third connects to the tank 31 through a pipe 38. The valve 36 has two operating positions. In the first position it connects pipe 34 to the vessel 25 via pipe 30; in the second position it connects pipe 30 to the tank 31 via pipe 38.

The vessel 25 is provided with a bypass pipe 39 interconnecting the volumes of the vessel 25 each side of spinnerette 15 via a valve 40.

In operation, the valve 35 is set to supply hot amine oxide to the vessel 25 through pipes 33 and 29 and the bypass valve 40 is opened. Valve 36 is set to connect pipe 30 to the sump tank 31 via pipe 38, Hot amine oxide is circulated through vessel 25 to soak the plates 13 without forcing a flow through the spinnerette jet holes 14. The plates are soaked in this way for about 15 to 30 minutes.

The valve 40 is then closed to cause the hot amine oxide to flow through the spinnerette jet holes in plates 13 to the sump tank 31.

After stopping the pump 32 the valve 35 is then set to connect pipe 34 to pipe 30 and valve 35 is set to connect pipe 29 to the sump tank 31 via pipe 37. Hot amine oxide is then circulated in the reverse direction through the spinnerette jet holes 14 to the sump tank.

After the spinnerette plates 13 have been thoroughly washed with hot amine oxide, the pump is stopped to allow hot AO to drain to the sump. The vessel 25 is opened and the spinnerette 15 is removed. The spinnerette is washed in a water ultrasonic bath 41. The plates 13 are then steam cleaned with a steam gun 22, dried and washed in trichlorethylene in the ultrasonic bath 42 (see FIG. 3). The spinnerette 15 is dried and inspected at station 43. The inspection station comprises a background lighting source over which the plates 13 to be inspected are placed. A skilled inspector checks to see if any of the jet holes 14 are still blocked and, if .necessary, dislodges the blockage with a fine probe (step 44) or returns the spinnerette to the steam cleaning stage 22 and ultrasonic cleaning in the trichlorethylene bath 42. When the spinnerette is pronounced clean at inspection it is then treated in a trichlorethylene ultrasonic bath 45 as a final polishing.

The spinning head is reassembled at station 46 using the cleaned housings 11, 12 and clean spinnerette 15 and support plate 17 and fresh filter gauze 18 and seals are used. The assembled spinning head 10 is then brought up to operating temperatures when needed for replacement in the fibre production plant by placing it in a heated enclosure 47.

We claim:

1. A method of cleaning and unblocking dope from jet holes in a spinnerette plate of a spinning head of a solvent-spun cellulose fibre manufacturing plant, said solvent comprising an amine oxide, the method comprising the steps of:

(a) scraping the bulk of the dope from the spinnerette plate, (b) soaking the spinnerette plate in an amine oxide solvent as used to make the dope, (c) causing the solvent to flow through the jet holes in a first direction, (d) causing the solvent to flow through the jet holes in the reverse direction to that of the first direction, (e) ultrasonically washing the solvent from the plates in hot demineralized water, (f) steam cleaning to remove regenerated residual cellulose from the jet holes, (g) ultrasonically washing the spinnerette plates in a cleaning agent which affects the physical properties of the regenerated cellulose rendering it more easy to dislodge the cellulose from the jet holes by the action of ultrasonic washing, and (h) ultrasonically washing regenerated cellulose from the jet holes.

2. A method according to claim i wherein the dope comprises an aqueous solution of cellulose in amine oxide, and the solvent used in steps (b), (c) and (d) is hot amine oxide.

3. A method according to claim 1 wherein the cleaning agent in step (g) is a chlorinated hydrocarbon.

4. A method according to claim 3 wherein the cleaning agent is trichlorethylene.

* * * * *

UNITED STATES PATENT AND TRADEMARK OFFICE

CERTIFICATE OF CORRECTION

PATENT NO. : 5,415,697

DATED : May 16, 1995

INVENTOR(S) : MacDonald et al

It is certified that error appears in the above-indentified patent and that said Letters Patent is hereby corrected as shown below:

Col. 1, line 8, cancel "Teneel" and substitute --Tencel-- (both occurrences).

Col. 4, line 27, cancel "35" and substitute --36--.

Col. 6, line 3, (Claim 2) cancel "8" and substitute --1--.

Signed and Sealed this

Seventeenth Day of October, 1995

Bruce Lehman

*Attest:*

BRUCE LEHMAN

*Attesting Officer*

*Commissioner of Patents and Trademarks*